US007207622B2

(12) United States Patent
Cohan et al.

(10) Patent No.: US 7,207,622 B2
(45) Date of Patent: Apr. 24, 2007

(54) REVERSIBLE LOUNGE CHAIR

(76) Inventors: Howard Cohan, 508-1 NE. 7th Ave., Fort Lauderdale, FL (US) 33301; Chrissa Paloni, 508-1 NE. 7th Ave., Fort Lauderdale, FL (US) 33301

( * ) Notice: Subject to any disclaimer, the term of this patent is extended or adjusted under 35 U.S.C. 154(b) by 0 days.

(21) Appl. No.: 11/154,275

(22) Filed: Jun. 16, 2005

(65) Prior Publication Data

US 2006/0284452 A1 Dec. 21, 2006

(51) Int. Cl.
*A47C 4/00* (2006.01)
*A47C 19/04* (2006.01)
*A47C 16/64* (2006.01)

(52) U.S. Cl. ..... 297/31; 297/22; 297/377; 297/900; 5/111; 5/112; 5/114

(58) Field of Classification Search ..... 297/31, 297/21, 22, 900, 377; 5/111, 112, 114, 620
See application file for complete search history.

(56) References Cited

U.S. PATENT DOCUMENTS

| | | | | | |
|---|---|---|---|---|---|
| 6,594 | A | * | 7/1849 | Lininkin | 297/377 X |
| 565,287 | A | * | 8/1896 | Logsdon | 5/111 |
| 793,428 | A | * | 6/1905 | Edgley | 297/377 X |
| 1,545,882 | A | | 7/1925 | Coopersmith | |
| 2,216,317 | A | * | 10/1940 | Karish | 297/377 X |
| D154,031 | S | | 6/1949 | Elsendrath | |
| D193,322 | S | | 7/1962 | Thomas | |
| D197,843 | S | | 3/1964 | Shelzl | |
| 3,179,465 | A | * | 4/1965 | Roberts | 297/377 X |
| 3,180,682 | A | | 4/1965 | Paulen | |
| 3,211,495 | A | | 10/1965 | Nielsen | |
| D226,061 | S | | 1/1973 | Kellman | |
| D233,090 | S | | 10/1974 | Laylon | |
| 4,508,384 | A | | 4/1985 | Castelot et al. | |
| 4,801,176 | A | | 1/1989 | Wolberg | |
| 4,921,301 | A | | 5/1990 | Haynes | |
| 5,246,265 | A | | 9/1993 | Nagan et al. | |
| 5,272,777 | A | * | 12/1993 | Favagrossa | 297/22 X |
| 5,297,850 | A | * | 3/1994 | Guleserian | 297/377 |
| 5,429,413 | A | | 7/1995 | Levy et al. | |
| 5,556,166 | A | * | 9/1996 | Synnestvedt | 297/377 |
| 5,681,089 | A | * | 10/1997 | Lin | 297/377 X |
| 5,823,617 | A | * | 10/1998 | Schafer | 297/31 X |
| 5,829,080 | A | | 11/1998 | Robillard et al. | |
| 5,946,749 | A | * | 9/1999 | Sewell | 297/900 X |

(Continued)

*Primary Examiner*—Rodney B. White
(74) *Attorney, Agent, or Firm*—Kevin P. Crosby; Daniel C. Crilly; Brinkley, Morgan et al.

(57) ABSTRACT

A lounge chair having a frame supported by legs, which may or may not have wheels incorporated therewith, and at least first and second adjustable backrest portions pivotally attached to the chair. When a sunbather wishes to sit on the lounge chair in an inclined position with his or her back supported, he or she inclines one of the backrest members which will position the sunbather in the most optimal position relative to the sun for sun bathing. As the sun passes overhead to a point which causes the sunbather's exposure to the sun to be diminished, the sunbather may merely drop the first backrest portion down to a horizontal or other desired position, adjust the second backrest portion to a position of inclination which suits the sunbather, and turn him or herself around 180° to lay in the opposite direction in the lounge chair.

15 Claims, 12 Drawing Sheets

U.S. PATENT DOCUMENTS 6,059,365 A * 5/2000 Diamond ..... 297/900 X
6,068,342 A * 5/2000 Mariani et al. ..... 297/900 X
6,079,777 A * 6/2000 Simmons et al. ..... 297/31 X
6,109,685 A * 8/2000 Lindsey et al. ..... 297/900 X
6,151,730 A * 11/2000 Weston ..... 5/111 X
6,213,555 B1 * 4/2001 Sulpizio et al. ..... 297/377
6,253,396 B1 * 7/2001 Weston ..... 5/111 X
6,588,034 B2 7/2003 Nation
6,860,567 B1 * 3/2005 Bauer ..... 297/900 X
D509,670 S 9/2005 Carter

* cited by examiner

REVERSIBLE LOUNGE CHAIR

FIELD OF THE INVENTION

This invention relates to seating devices, and more particularly relates to an outdoor, reversible lounge chair.

BACKGROUND OF THE INVENTION

Cruise ships and resort hotels place chaise lounges throughout their facilities for use by their guests. Many times, multiples of these lounges are in a row. The resulting image is appealing, with the lounges all uniformly positioned. Frequently, however, these arrangements do not suit the guest's goals.

When a person desires to sunbathe, he or she will use one of the lounge chairs that provide the desired level of sun exposure. The sunbather then adjusts the adjustable backrest to a comfortable position, and lays down. However, after several hours, the position of the sun has changed, and the sunbather is no longer receiving the desired level of exposure because of the shadows cast by the sunbather on him or herself. The sunbather is then left with two options, find a new chair that maximizes exposure to the sun or turn their current chair around so that the shadow is behind them again. These arrangements result in competition for "morning sun" chairs and "afternoon sun" chairs and/or disruption of the uniformly positioned rows that must then be rearranged each night.

There is, therefore, a need for reversible lounge chairs that allow sunbathers to position themselves so that they can utilize either end of the chair as the head of the chair and thereby follow the course of the sun during the day without changing or moving chairs.

U.S. Design Pat. No. D233,090 to Laylon teaches a chaise lounge that would look appealing near a pool or on a deck. Unfortunately, only one panel of Laylon acts as an adjustable backrest. Therefore, there is still a need to provide a reversible lounge chair.

U.S. Design Pat. No. D154,031 to Eisendrath teaches a combination love seat, lounge, and bed. Similar to the present invention, Eisendrath teaches the ability to raise either end (FIG. 6). However, the material utilized in a love seat, lounge or bed would not be capable of withstanding the elements. Therefore, there still exists a need for reversible lounge chairs for sunbathers.

Many inventors have targeted lounge chairs for pregnant women that, on initial glance, appear to meet the limitations of the present invention. For example, U.S. Pat. No. 4,508,384 to Castelot et al. teach a lounge chair having four sections. The middle section has been adapted so that a pregnant woman can lay on her stomach. A fourth section is included that can be positioned either on top of the middle section or the foot rest. When a pregnant woman lays on her back, the fourth section is placed over the middle section so that she does not sink through the adjustable stomach holder. When the pregnant woman lays on her stomach, the fourth section is placed over the foot rest. The fourth section is not capable of being placed in any other position and therefore does not meet the limitations of the present invention.

U.S. Pat. No. 6,588,034 to Nation also provides a beach chair for pregnant women. The chair is foldable so that it is portable. However, as evidenced by FIG. 2, it is only possible to inclined one side of the chair.

Nagan et al. (U.S. Pat. No. 5,246,265) teaches a folding lounge chair. The foot rest and backrest of Nagan can be engaged in more than one locking position throughout their pivotal movement. However, Nagan never indicates that the foot rest can become the backrest or that the backrest can become the footrest. The distinction maintained between the two throughout the specification and claims imply that they cannot. In addition, Nagan is a portable chair that would not be able to withstand the elements if left outside for long periods of time. There is still a need for sturdy, reversible lounge chairs for sunbathers.

SUMMARY OF THE INVENTION

In order to overcome these and other shortcomings in the lounge chair field, and to achieve the objectives referenced herein, we have invented a variety of embodiments of a lounge chair which permit a sunbather to take maximum advantage of the incident angle of the sun's rays throughout the course of a sunbathing day without having to rotate or otherwise move the lounge chair. The invention is directed to a lounge chair having a frame supported by legs, which may or may not have wheels incorporated therewith, and at least first and second adjustable backrest portions pivotally attached to the chair. When a sunbather wishes to sit on the lounge chair in an inclined position with his or her back supported, he or she inclines one of the backrest members which will position the sunbather in the most optimal position relative to the sun for sun bathing. As the sun passes overhead to a point which causes the sunbather's exposure to the sun to be diminished, the sunbather may merely drop the first backrest portion down to a horizontal or other desired position, adjust the second backrest portion to a position of inclination which suits the sunbather, and turn him or herself around 180° to lay in the opposite direction in the lounge chair.

The invention may optionally include one or more reversible armrests, as well as one or more retractable convenience trays, and/or a covered umbrella-type device on one or either side.

BRIEF DESCRIPTION OF THE DRAWINGS

FIG. 6 is a perspective view of the alternate lounge chair with both backrest portions inclined.

FIG. 7 is a second perspective view of the chair in FIG. 6.

FIG. 8 is a top plan view of the chair in FIG. 6 showing two convenience tables and their direction of movement.

FIG. 9 is a side elevational view of the chair in FIG. 6 showing both backrests inclined.

FIGS. 10 through 13 show a perspective view of the chair of FIG. 6 and illustrate the range of motion of the optional armrest.

FIGS. 14A through 16 show a third embodiment of the lounge chair of the present invention.

FIG. 14A and FIG. 16 show two different perspective views of this embodiment of the lounge chair with both backrest portions inclined.

FIG. 15 is a top plan view of the same lounge chair as in FIG. 14 and FIG. 16 showing one convenience table and its direction of movement.

FIGS. 17 and 19 show two different perspective views of this embodiment of the lounge chair.

FIG. 18 is a top plan view of the same lounge chair as in FIGS. 17 and 19 showing two convenience tables and their direction of movement.

DETAILED DESCRIPTION

Figure 1:
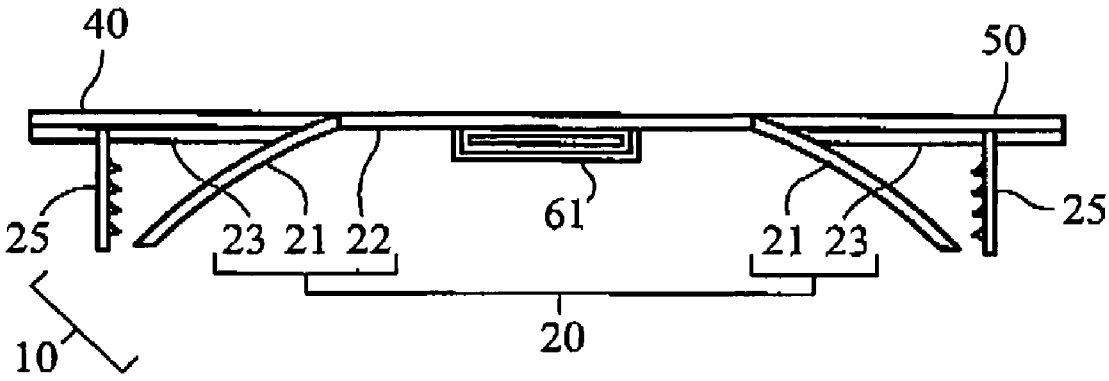
FIG. 1 is a side elevational view of one embodiment of a lounge chair of the present invention with both the first and second backrest portions in the horizontal position.

Generally, the present invention encompasses lounge chairs which permit a sunbather to take maximum advantage of the incident angle of the sun's rays throughout the course of a sunbathing day without having to rotate or otherwise move the chair. The invention is directed to a lounge chair having a frame supported by legs, which may or may not have wheels incorporated therewith, and at least first and second adjustable backrest portions pivotally attached to the chair. When a sunbather wishes to sit on the lounge chair in an inclined position with his or her back supported, he or she inclines one of the backrest members which will position the sunbather in the most optimal position relative to the sun for sun bathing. As the sun passes overhead to a point which causes the sunbather's exposure to the sun to be diminished, the sunbather may merely drop the first backrest portion down to a horizontal or other desired position, adjust the second backrest portion to a position of inclination which suits the sunbather, and turn him or herself around 180° to lay in the opposite direction on the lounge chair.

This description contains specific details describing preferred embodiments of the invention so that it may be practiced by one skilled in the art. The present invention may be more readily understood with reference to FIGS. 1 through 19, in which like reference numerals designate like items.

FIGS. 1 through 5 illustrate one embodiment of a lounge chair in accordance with the present invention. FIG. 1 depicts a side elevational view of this lounge chair 10. The lounge chair 10 has a frame 20, which may be made of aluminum or other material capable of supporting the weight of one or more persons and, preferably, of resisting deterioration brought on by outdoor exposure. The benefits of aluminum include, among other things, weather resistance and the ability to be produced in a variety of colors. However the present invention is not limited to aluminum frames 20 and can include any materials that are capable of supporting one or more sunbathers and withstanding the elements of nature.

Frame 20 includes leg members 21, side members 22, and support members 23. In the embodiment depicted in FIG. 1, the leg members 21 curve downward from the horizontally-aligned side members 22. Support members 23 are aligned horizontally as well, but below the plane in which the side members 22 lie, or can be nested and hence in the same plane in which the side members 22 lie. This allows the first backrest portion 40 and second backrest portion 50, which rest upon or are located on top of support members 23, to be located in the same plane as middle seat member 30, which is located in the same plane and between side members 22.

Leg members 21 and side members 22, or side members 22 and support members 23, may be made of one piece of aluminum to provide additional strength and/or aesthetic appeal to the lounge chair 10. However, this is not required to practice the present invention.

Figure 2:
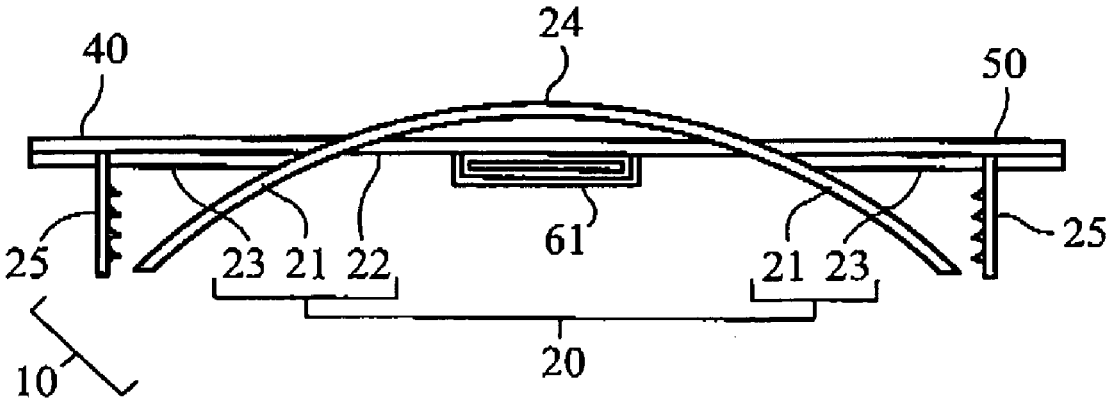
FIG. 2 is a side elevational view of a modified embodiment of the lounge chair of FIG. 1 including optional arm rests.

FIG. 2 is a side elevational view of the lounge chair 10 of FIG. 1 with the addition of an optional arm rest 24. In the embodiment shown in FIG. 2, arm rest 24 aligns with leg members 21 to form a curve. In this embodiment, it is possible to make arm rest 24 and leg members 21 co-extensive. As will become evident upon further disclosure, the embodiment of arm rest 24 provided in FIG. 2 can be utilized when either first backrest portion 40 or second backrest portion 50 are inclined. Any symmetrically arranged armrest structure is contemplated to be within the scope of the invention.

Figure 4:
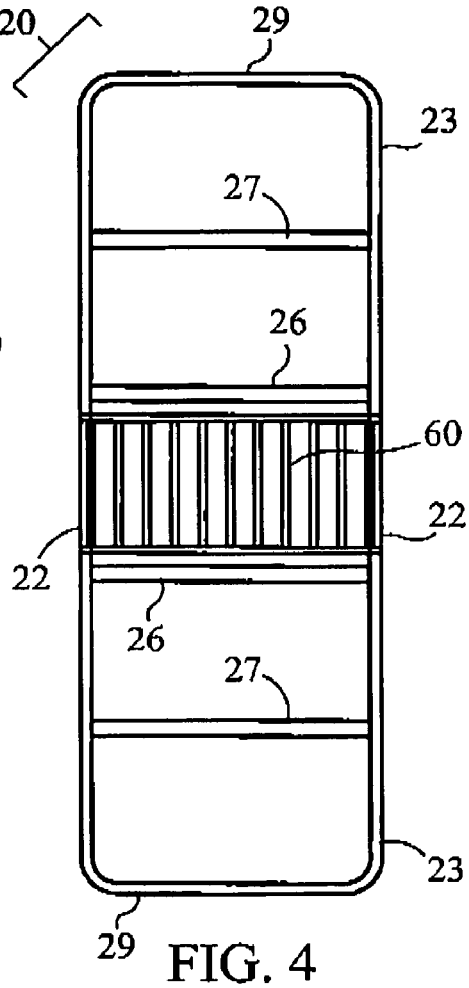
FIG. 4 is a bottom view of the lounge chair of FIGS. 1 & 2.
Figure 5:
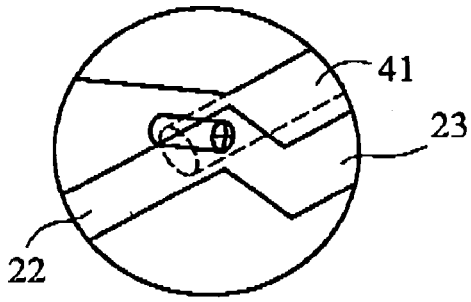
FIG. 5 is a close-up view of a hinge suitable for use with the backrest of the lounge chair in FIGS. 1 & 2.

FIGS. 1 and 2 both include one of many possible structures for an optional convenience table 60 (shown retracted in FIG. 4). A rectangular U-shaped frame 61 is attached to the bottom of side members 22. Convenience table 60 slides along rectangular frame 61 so that it can slidingly extend to either side of the lounge chair 10. The rectangular frame 61 may extend like a tunnel the entire distance from one side member 22 to the second side member 22, in order to provide support for convenience table 60 when in use. Therefore, when a heavy beverage or book is placed on one end of convenience table 60, the rectangular frame 61 supports the opposite end and prevents the convenience table 60 from tipping. An alternative embodiment may utilize one or more intermediate rectangular table-supporting frame members (not shown) across the width of middle seat member 30 in registry with table 60. Other embodiments may include one or more stop members (not shown) to prevent the convenience table 60 from being inadvertently or deliberately removed in its entirety from the lounge chair 10.

FIGS. 1 and 2 also include support struts 25. Support struts 25 are pivotally connected to U-shaped member 41 of the first backrest portion 40 and the U-shaped member 51 of the second backrest portion 50. Support struts 25 mate with the frame 20 in a variety of positions to permit the respective backrest portions to be releasably held in a variety of positions.

Figure 3:
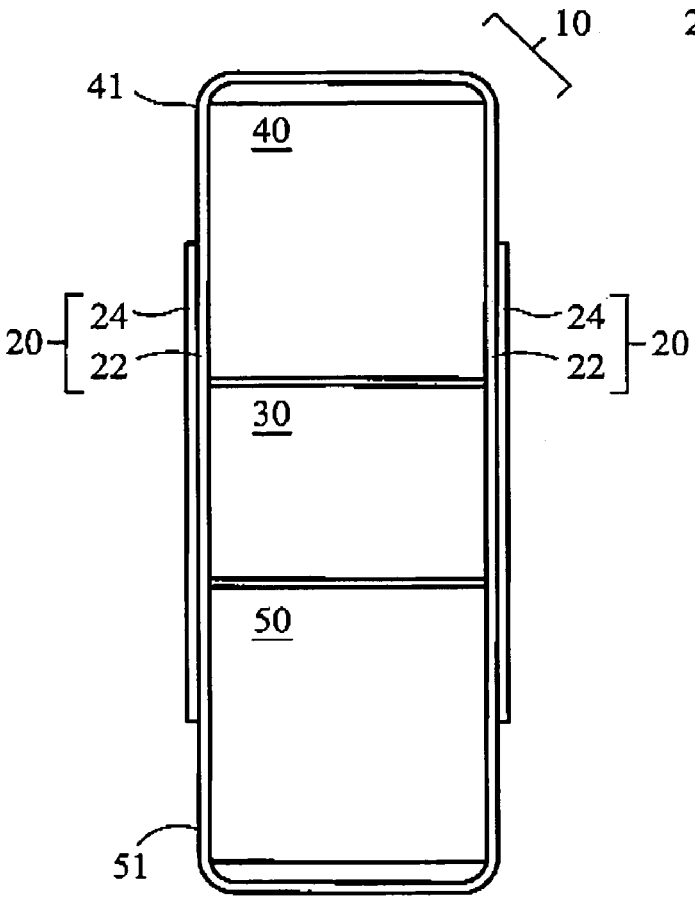
FIG. 3 is a top plan view of the lounge chair of FIG. 2.

FIG. 3 is a top plan view of the lounge chair 10 of FIG. 1. As previously discussed, middle seat member 30 is substantially rigidly connected between the side members 22 of frame 20. First backrest portion 40 is located on one side of middle seat member 30 and pivotally connected to either the frame 20 or middle seat member 30. Second backrest portion 50 is pivotally connected to either the frame 20 or middle seat member 30 on the opposite side of middle seat member 30. As will become evident upon further inspection, first backrest portion 40 and second backrest portion 50 are pivotally connected to chair 10 so that they can be selectively inclined or reclined to suit the person sitting in the chair 10. It may be possible to add an adjustment mechanism to facilitate changing the positions of the support struts while allowing the sunbather to remain seated on the chair.

In the embodiment provided in FIG. 3, middle seat member 30 is a fixed panel. This panel can be made of cloth, plastic, wood or any other material suitable for the intentions of the present invention. Preferably, first backrest portion 40 and second backrest portion 50 are made of the same material as middle seat member 30. However, this is not required to practice the present invention.

First backrest portion 40 and second backrest portion 50 both include U-shaped members, 41 and 51 respectively. Preferably, the U-shaped members, 41 and 51, are made of the same material as frame 20. Once again, however, this is not a requirement of the present invention. The U-shaped members, 41 and 51, are pivotally connected to frame 20 or seat 30 at or near side members 22. As depicted in the view of FIG. 3, the U-shaped members, 41 and 51, may be nested inside (as shown) or outside (not shown) of side member 22.

FIG. 4 is a bottom plan view of a portion of the frame 20, including side members 22 and support members 23. The leg members 21 and the backrest portions, 40 and 50, are not included in this Figure.

Side members 22 may be joined to two intermediate frame members 26 to form a rectangle (FIG. 4).

As evident from FIG. 4, support members 23 are U-shaped. Support members 23 may include brace members 27. To incline backrest members 40 or 50, support struts 25 releasably mate with respective end frame members 29.

FIGS. 6 through 13 provide a second embodiment of a lounge chair 100 in accordance with the present invention. In the embodiment shown, the chair 100 is made of wood, such as teak, cypress or any other suitable wood.

Figure 6:
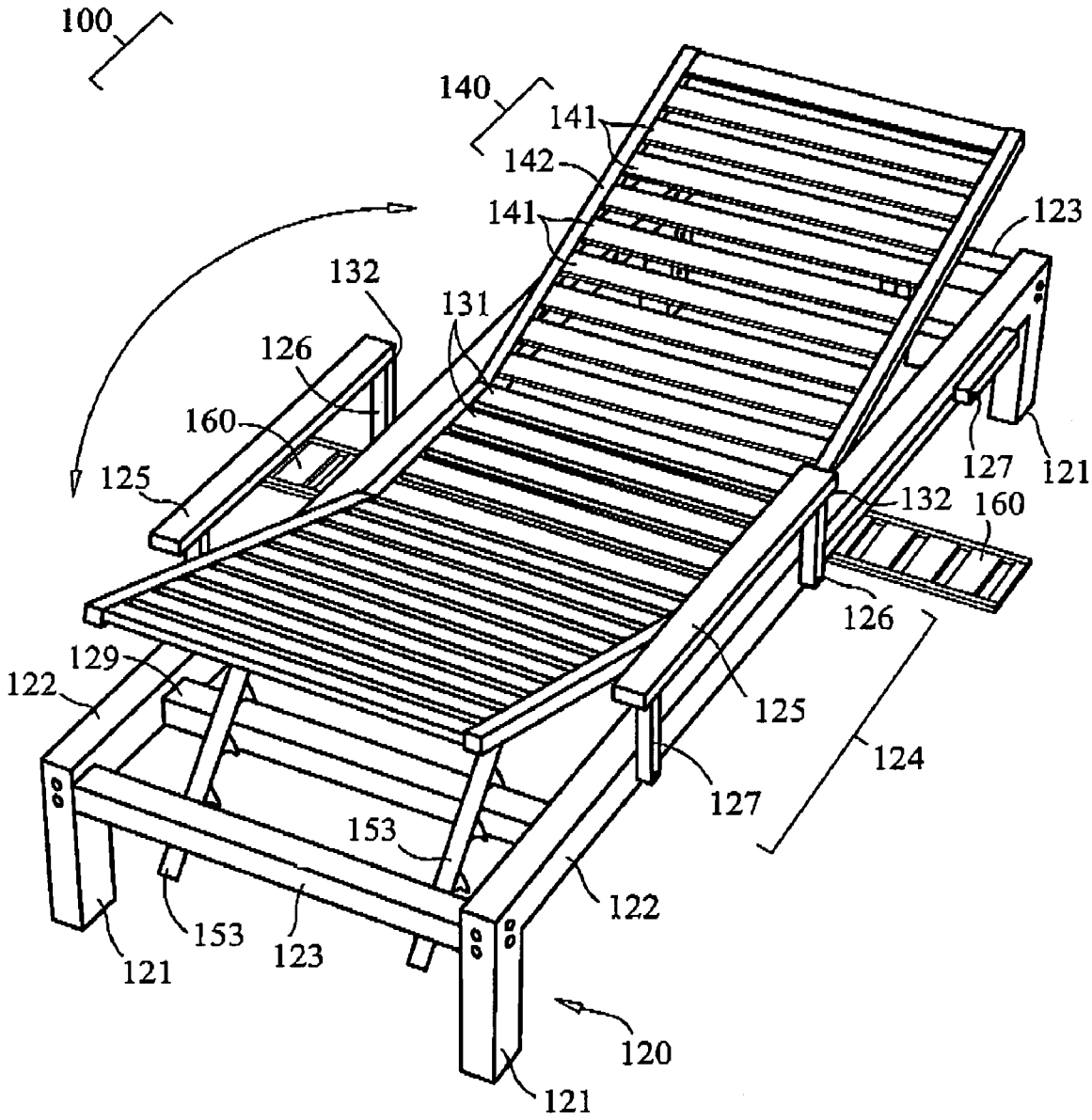
FIGS. 6 through 13 are a second embodiment of the lounge chair of the present invention.
Figure 7:
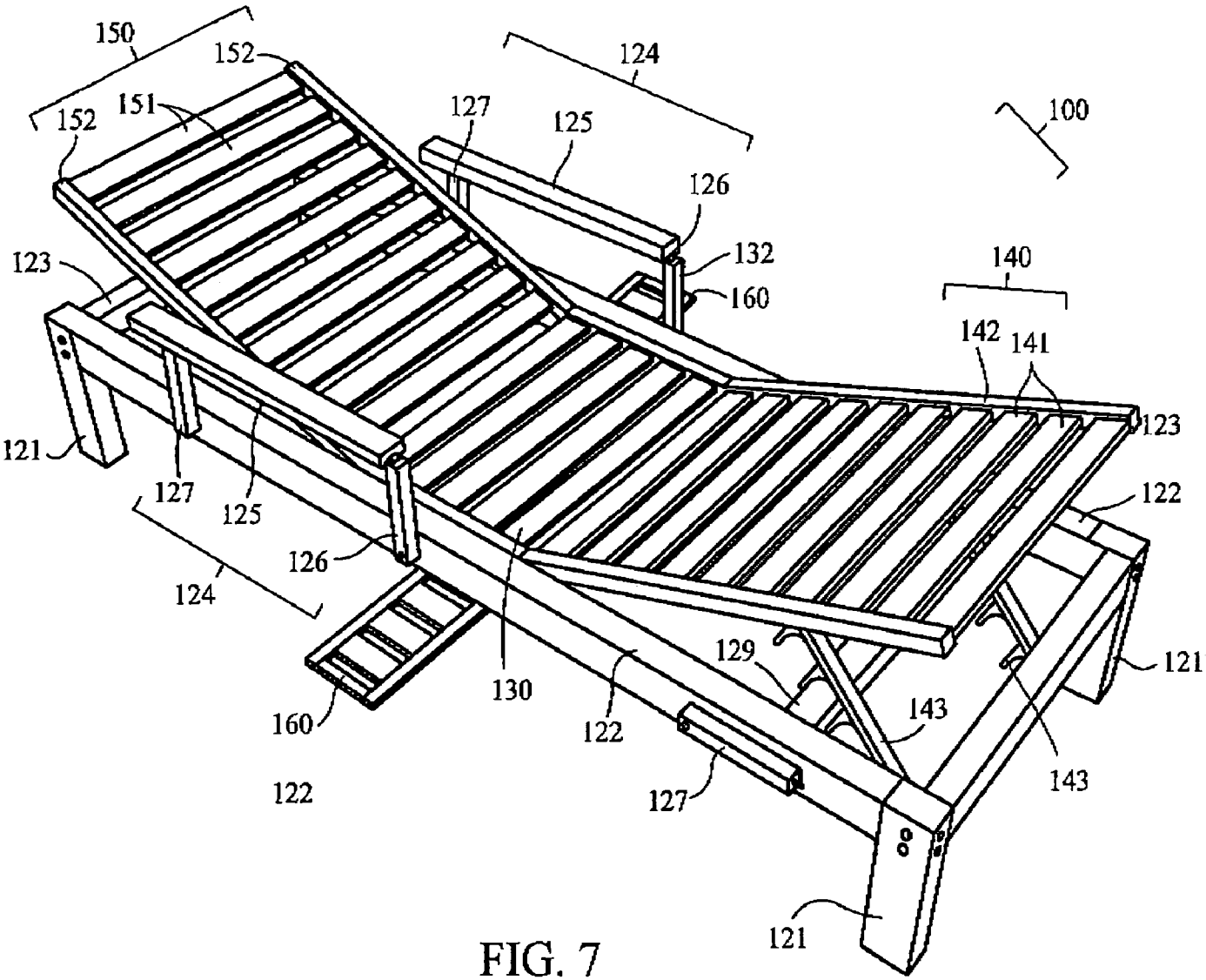
Figure 8:
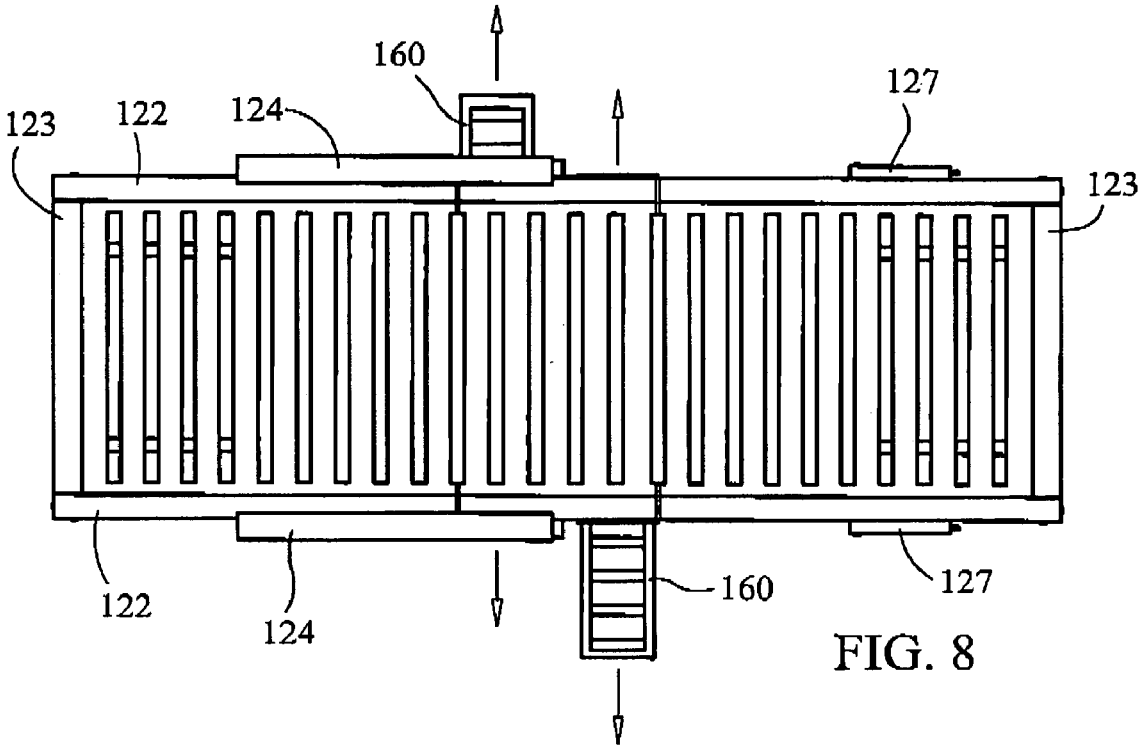

FIGS. 6 and 7 are perspective views of this embodiment of the chair 100. Once again, and in accordance with the teachings of the present invention, it is possible to elevate both backrests, 140 and 150.

The frame 120 in this embodiment may employ any number of legs, including four legs 121 as depicted in FIGS. 6 through 13, one at each corner of the chair 100. Wheels (not shown) may or may not also be employed. Two side frame members 122 are joined to the legs 121. Two end frame members 123 traverse from one side frame member 122 to the other. The two side frame members 122 and the two end frame members 123 take the shape of a rectangle.

The arm rests 124 are also reversible. Arm rest 124 is made of an arm resting member 125, an arm rest support member 126, and an arm resting member strut 127. The arm resting member 125 is pivotally connected to the arm rest support member 126. The pivoting attachment mechanism 132 allows the arm resting member 125 to be utilized as an arm rest regardless of the position of the person using the chair 100. All the person has to do is pivot the arm resting member 125 to the side of the chair the person's head is on.

The arm resting member strut 127 is pivotally connected to the side frame member 122 of the frame 120. When in use, the arm resting member strut 127 is moved perpendicular to the frame 120. When not in use, the arm resting member strut 127 is parallel to the frame 120. FIGS. 10 through 13 illustrate the reversibility of the arm rest 124.

Figure 9:
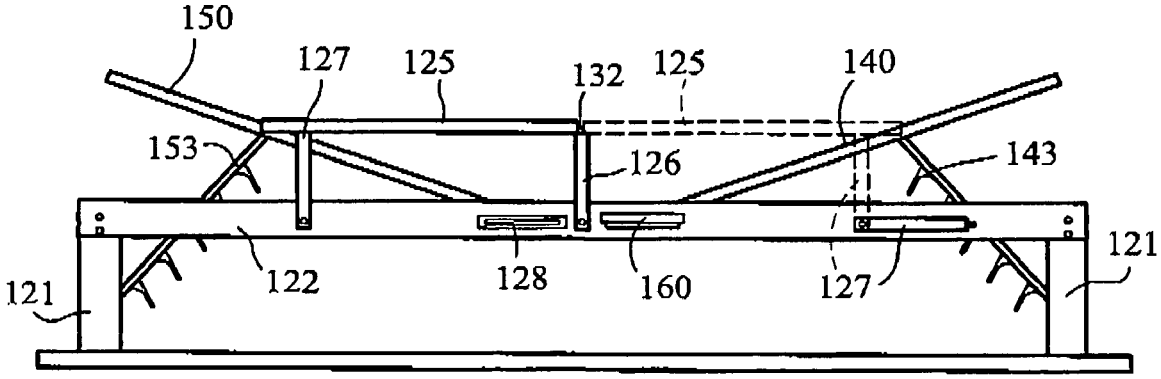
Figure 10:
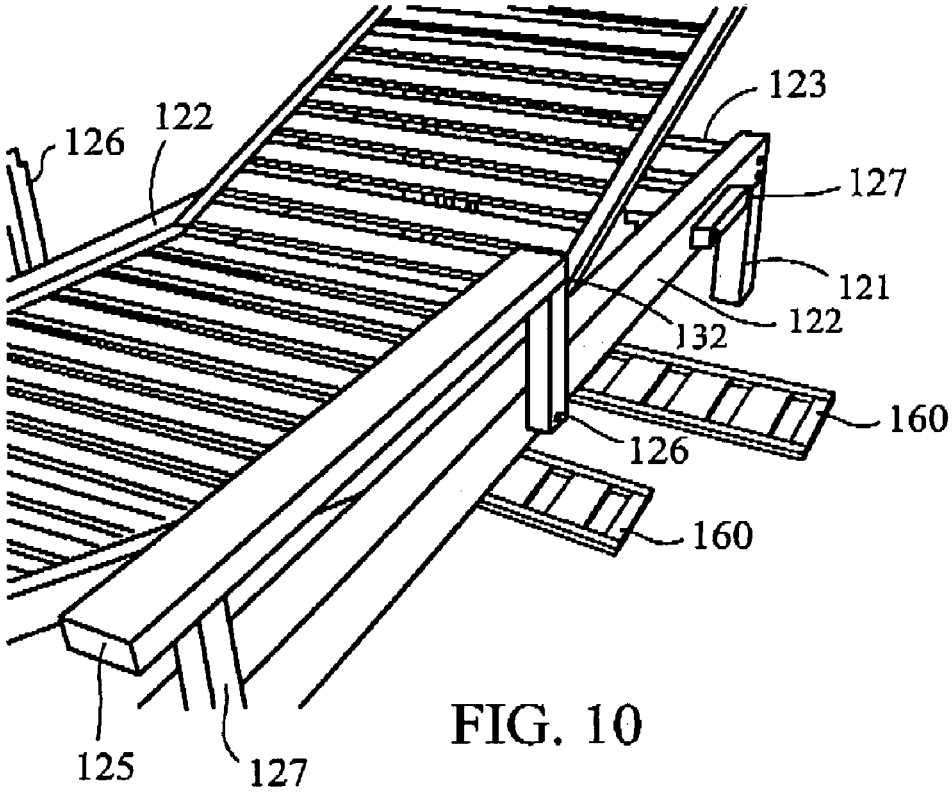
Figure 11:
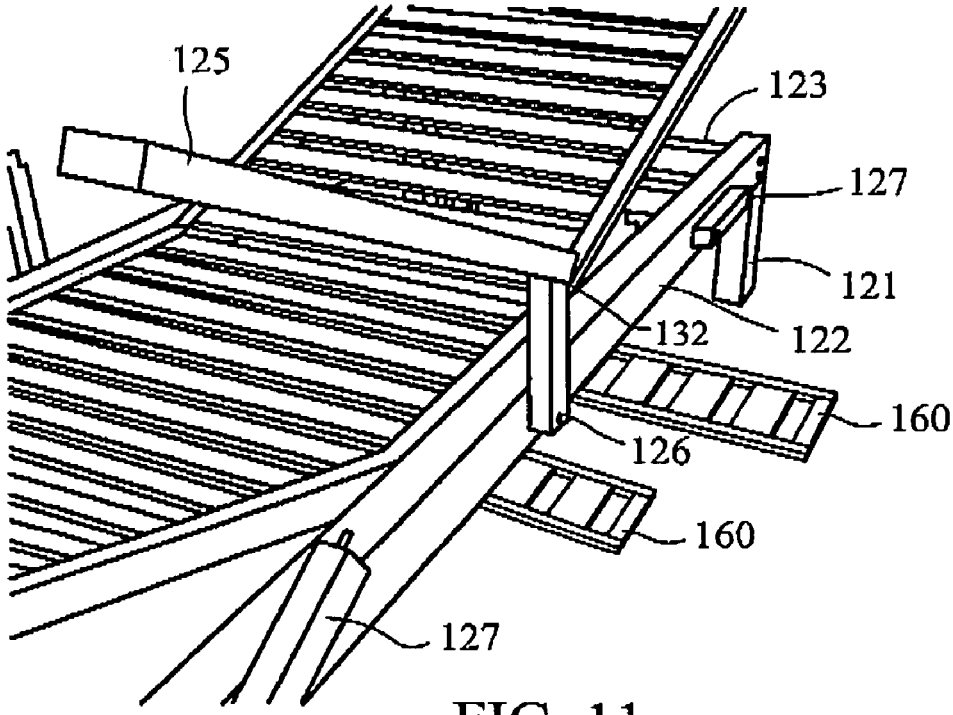
Figure 12:
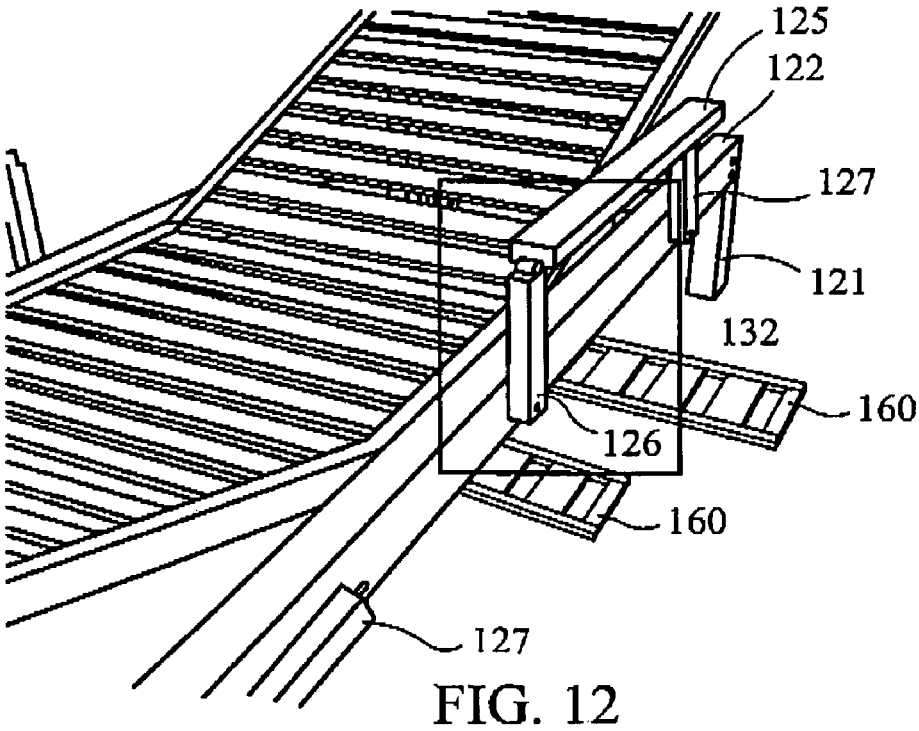
Figure 13:
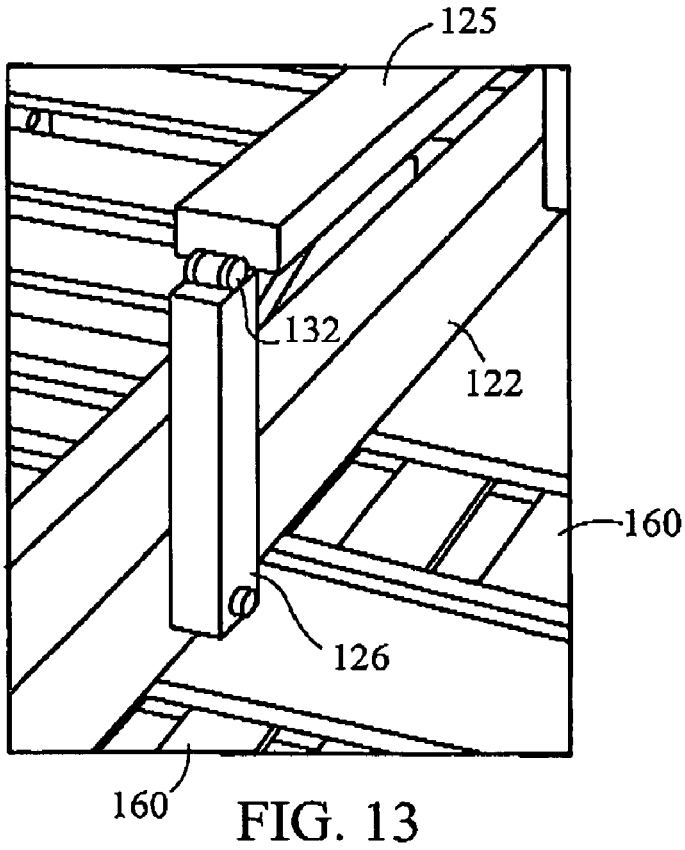

Two convenience tables 160 are provided in the embodiment depicted in FIGS. 6 through 13. The convenience tables 160 may be a part of the frame 120. As illustrated in FIG. 9, side frame member 122 defines two apertures 128 (only one is visible because the second is occupied by the convenience table 160) through which convenience table 160 slides, thereby allowing access to the convenience table 160 from either side of the chair 100. One of ordinary skill in the art will recognize that the number of apertures 128 utilized will vary depending on the intended purpose of the chair 100.

In the embodiment provided in FIGS. 6 through 13, the middle seat member 130 is actually a plurality of panels of wood 131 that traverse from one side frame member 122 to the other. It is obvious that the number of panels of wood 131 utilized can vary.

The first backrest portion 140 and the second backrest portion 150 are also made of multiple panels of wood 141 and 151. The panels 141 and 151 are supported between two frame members 142 and 152. Unlike the previous embodiment in which the support strut 25 was connected to the U-shaped member, 41 or 51, of the backrest portion, 40 or 50, the support struts 143 or 153 in the present embodiment are pivotally connected to one the panels of wood 141 and 151. However, the support struts 143, 153 may in the alternative be pivotally connected to the frame members 142, 152, respectively. The support struts 143 and 153 adjustably mate with the brace member 129 of the frame 120 to permit the inclination of the backrest portions, 140 and 150. The embodiment provided in FIGS. 6 through 13 illustrates two support struts 143 (or 153) per backrest portion 140 (or 150). Both of the support struts 143 (or 153) are narrow in width. An alternate embodiment would provide for one wide support strut (not shown) or more than two narrow support struts (not shown). No matter what number and size of support struts 143 or 153 are chosen, the support struts employed should be strong enough to support even the largest resting human.

As depicted in FIGS. 6 through 13, all three members of the seat (the middle seat member 130 and both backrest portions 140 and 150) may be nested inside the side frame members 122. The end frame members 123 serve as the stop mechanism for both the first backrest portion 140 and the second backrest portion 150 when the support strut 143 or 153 is not mated with the brace member 129.

FIGS. 14A through 16 show a third embodiment of the lounge chair invention 300, which includes a generally rectangular frame comprised of right and left side frame rail members 310 and 312, respectively, and first and second end frame members 314, 316, respectively. Any suitable leg arrangement may be utilized with the invention, such as generally U-shaped legs 318. Chair 300 employs a central seating area 330 which is substantially fixed relative to chair 300. Chair 300 also employs first and second backrest portions 340 and 350, respectively, which are constructed of frame members 341 and 351, respectively, and straps, 342 and 352, respectively, such as fabric, vinyl, or PVC straps, or any other material capable of acting as seating material, strung between opposed side frame members of frames 341 and 351, respectively and central seating portion 330 (the straps for seating portion 330 are 332). First and second back rest portions are rotatably connected to either frame 310 and 312 or to central seating portion 330 in any suitable manner, such as by the hinge pin assembly (FIG. 5) shown in connection with the first embodiment of this invention. However, it is to be understood that any suitable hinge arrangement which will occur to one of skill in the art is contemplated to be within the scope of this invention.

Figure 14A:
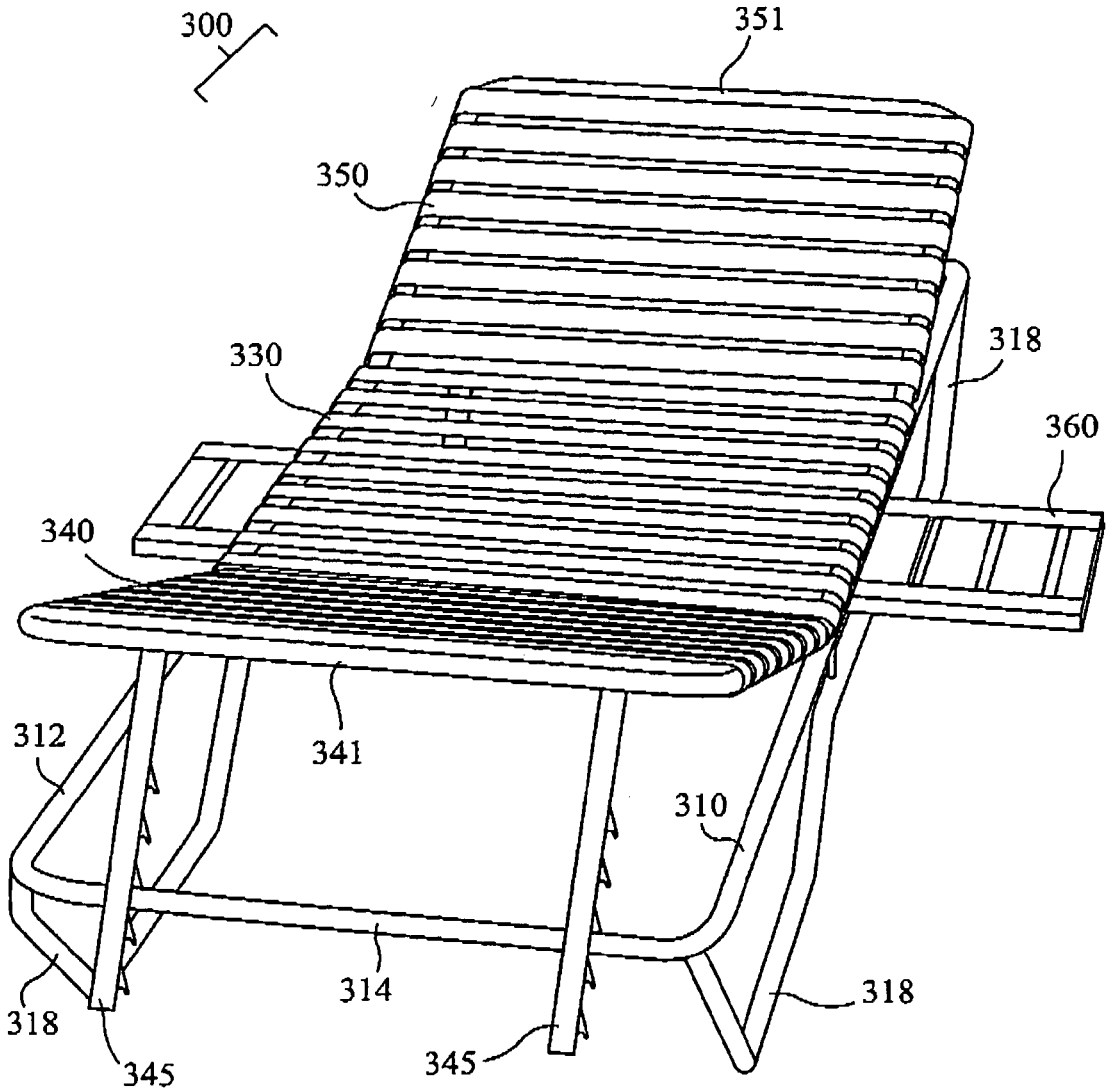
Figure 14B:
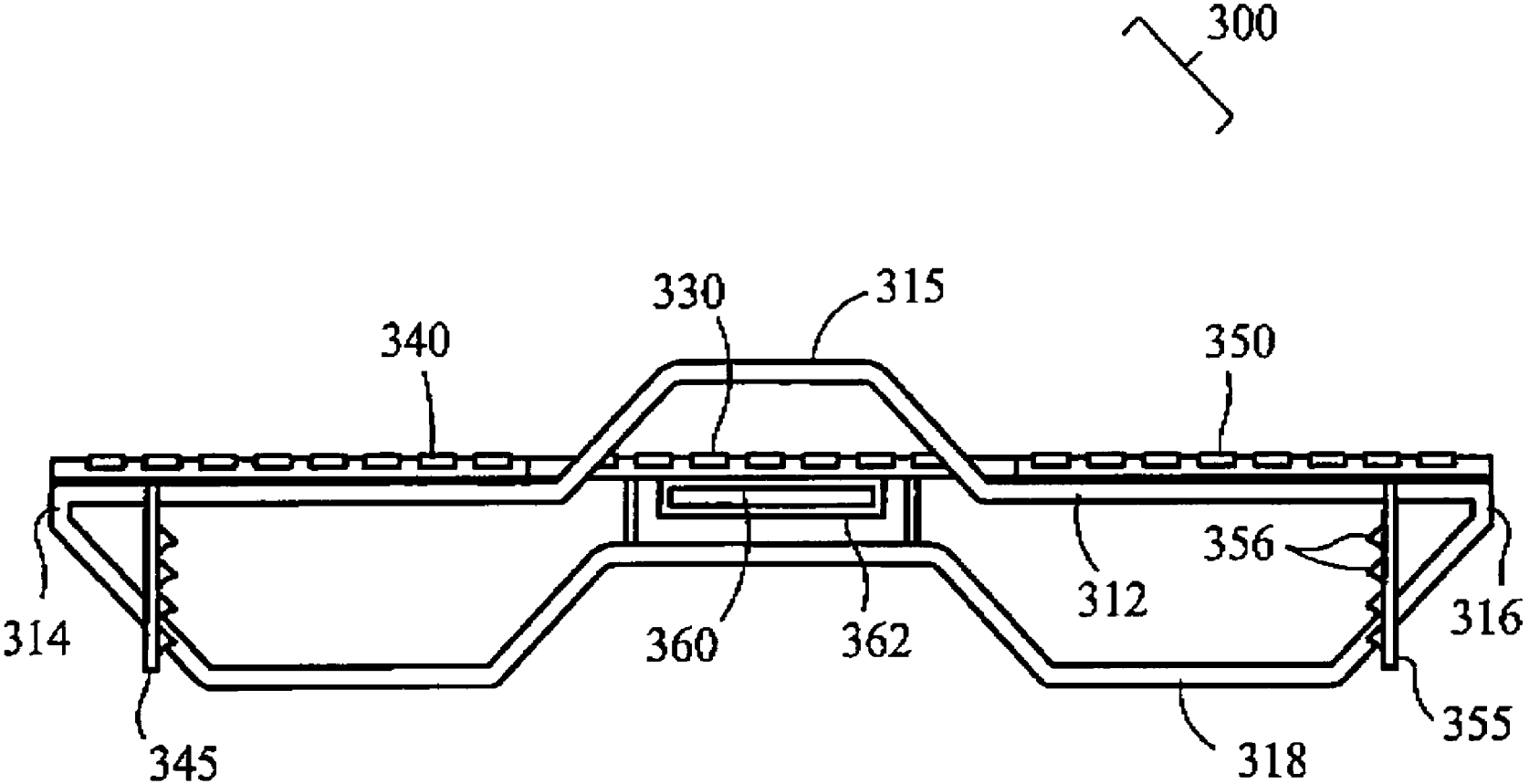
FIG. 14B is a side elevation view including an optional arm rest.
Figure 15:
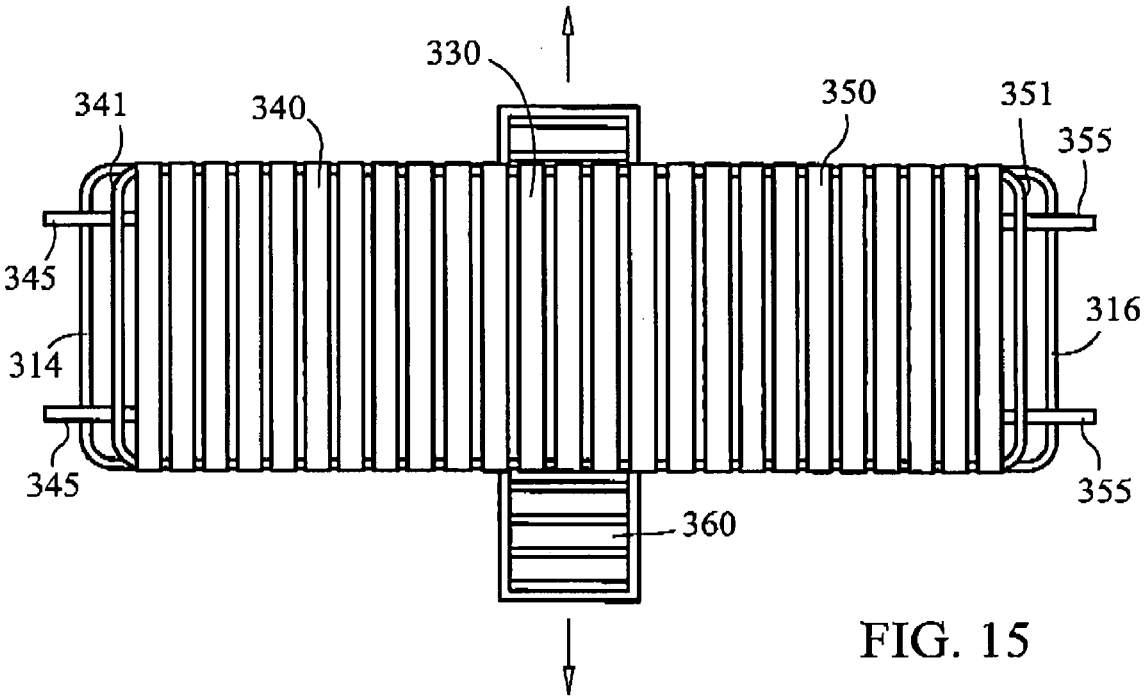
Figure 16:
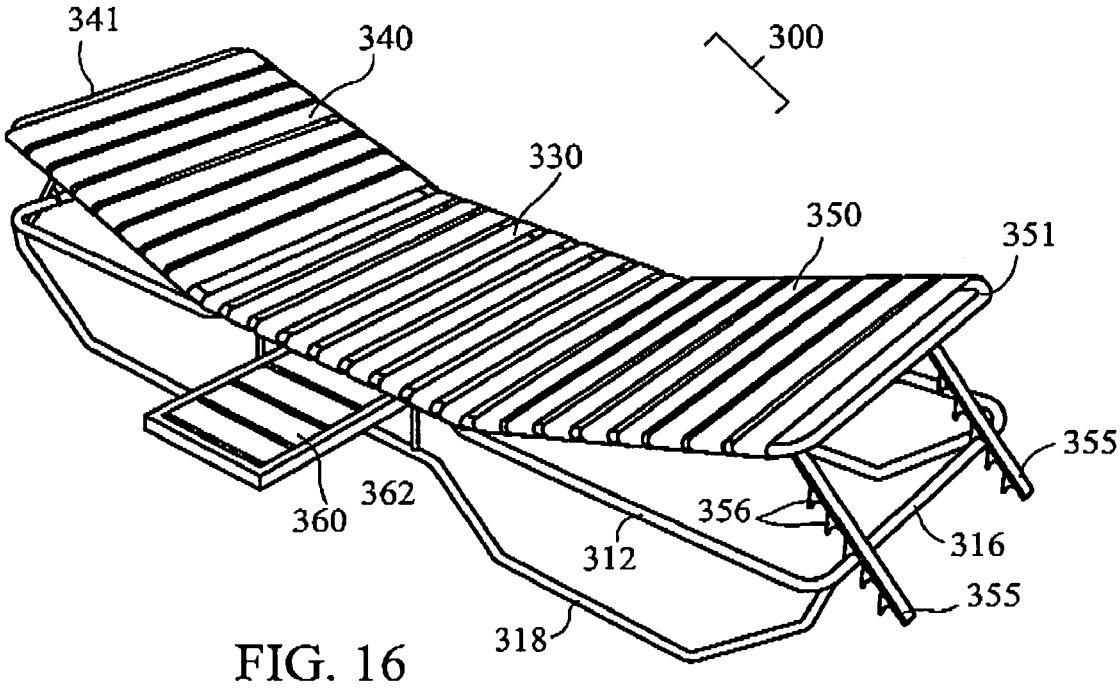

FIG. 14B is a side elevation view including an optional arm rest 315.

One or more support struts 345 and 355 are employed to adjustably support first and second back rest portions 340, 350 in any one of a plurality of positions.

One or more convenience trays 360 may be slidingly or pivotally connected to chair 300 to act as a table adjacent to the chair. Tray 360 may be slidingly attached to chair 300 by any suitable means, such as through one or more U-shaped members 362 connected to the underside of chair 300, or by a hinge (not shown).

Support struts 345 and 355 define serrations 346 (not shown) and 356 which in turn define shoulders which engage first and second frame end members 314 and 316, respectively, to independently and selectively support first and second back rest portions 340 and 350, respectively.

Figure 17:
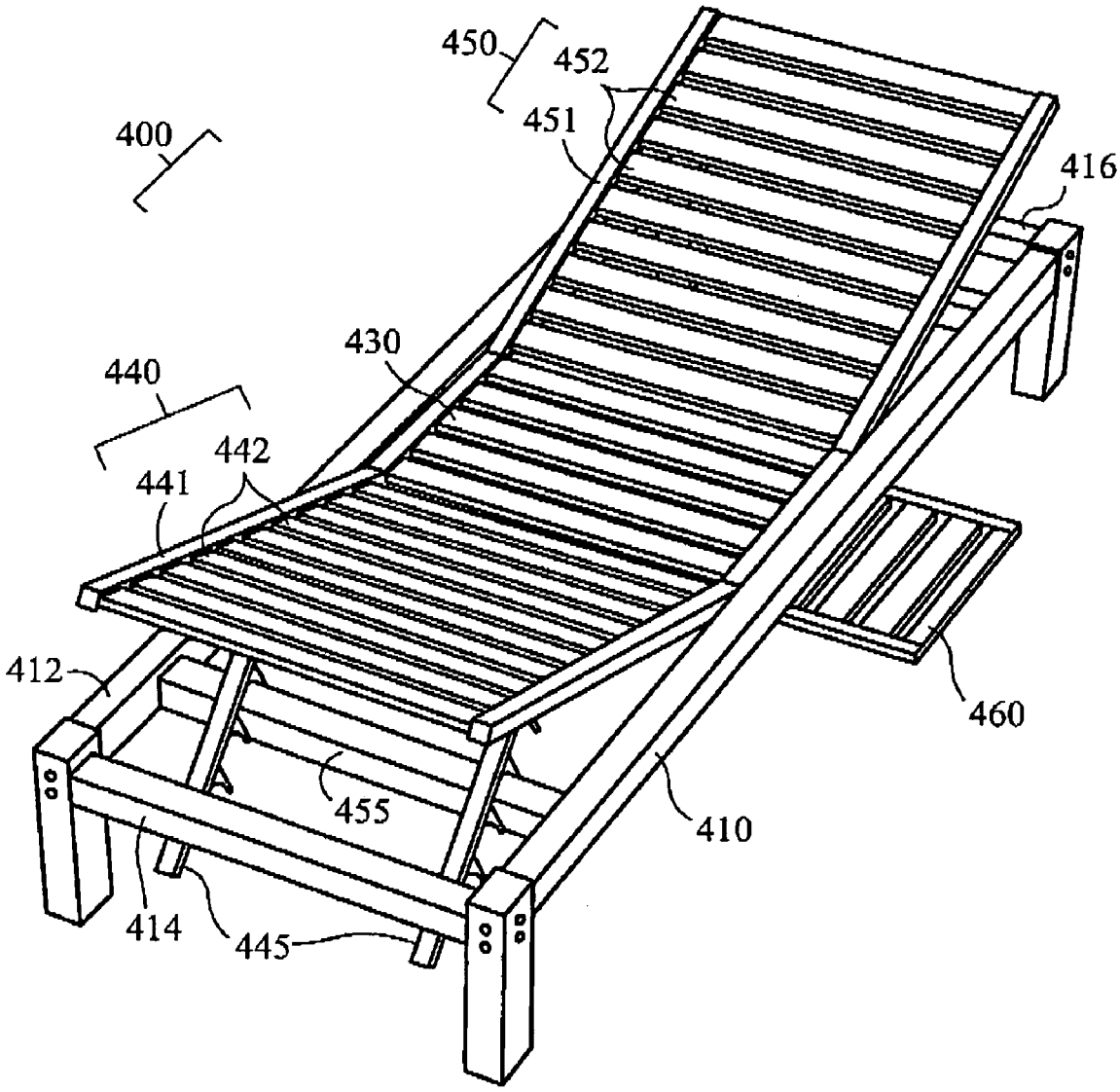
FIGS. 17 through 19 show a fourth embodiment of the lounge chair of the present invention with both backrest portions inclined.
Figure 18:
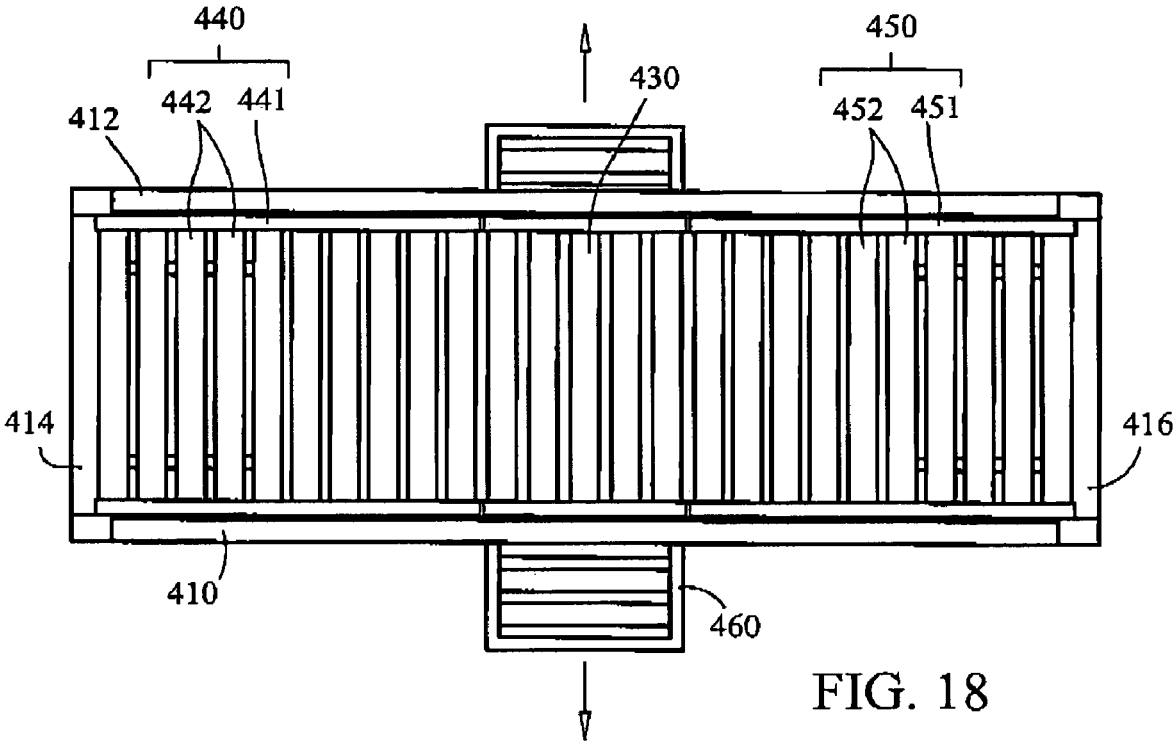
Figure 19:
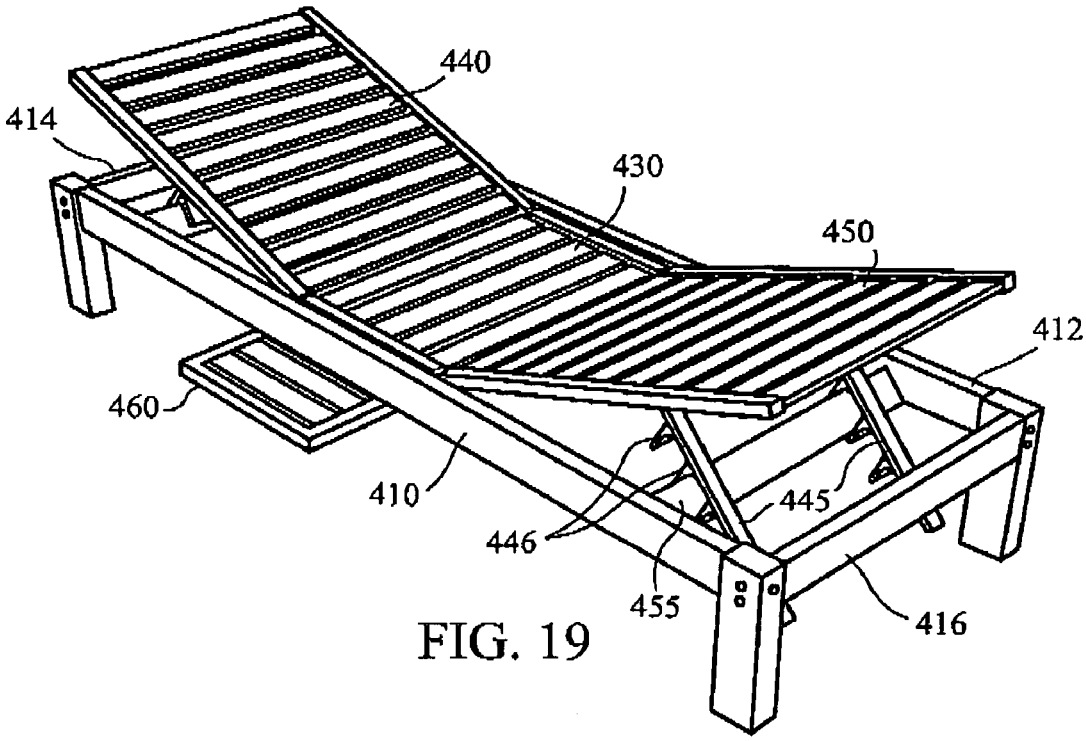

FIGS. 17 through 19 show a fourth embodiment of the invention, wherein a lounge chair 400 is comprised of a frame, which may be oriented in a rectangular shape and comprised of right and left side frame members 410 and 412, respectively, and first and second frame end members 414, 416. A middle seat member 430 is connected to the frame and is substantially stationary relative thereto. First and second back rest portions 440 and 450, respectively, are defined by frame members 441 and 451, respectively, and transverse slats 442 and 452, respectively.

First and second back rest portions 440 and 450 are pivotally connected to side frame members 410 and 412 and are independently adjustable between completely lowered positions (not shown) in which they are generally parallel to side frame members 410 and 412 to a fully inclined position, and are adjustable to intermediate positions there between by the use of the one or more support struts 445.

Support struts 445 define serrations 446 which in turn define shoulders which engage intermediate frame member 455, to independently and selectively support first and second back rest portions 440 and 450, respectively.

One or more convenience trays 460 may be slidingly or pivotally connected to chair 400 to act as a table adjacent to the chair. Tray 460 may be slidably attached to chair 400 by any suitable means, such as through one or more U-shaped members (not shown) connected to the underside of chair 400, or by a hinge (not shown).

The lounge 400 of the fourth embodiment may be manufactured of polymer resin, PVC piping, teak, or any other wood, corrosion resistant metal, or any other material suitable for outdoor use.

While four specific configurations of the lounge chair have been shown and discussed, the claims of this invention are directed to lounge chairs that have two adjustable backrests in order to permit a sunbather to obtain the desired level of exposure to the sun. There are many configurations of a lounge chair that would accomplish the same object. For example, it may be desirable to create lounge chairs with folding and/or retractable legs so that the chairs may be stacked at the end of the season or for cleaning. In addition, it may be desirable to create a wider chair so that two or more people may utilize it at the same time. One of ordinary skill in the art would also recognize that the materials referenced for each embodiment are interchangeable. In other words, all of the embodiments depicted in the Figures and any other embodiments covered by the appended claims can be made of polymer resin, PVC piping, teak, or any other wood, corrosion resistant metal, or any other material suitable for outdoor use.

REFERENCES

10 Lounge Chair
20 Aluminum Frame
21 Leg members
22 Side members
23 Support members
24 Arm rest
25 Support struts
26 intermediate frame member
27 brace member
29 End frame member
30 Middle seat member
40 First backrest portion
41 U-shaped member
50 Second backrest portion
51 U-shaped member
60 Convenience table
61 Rectangular frame
100 chair
120 frame
121 legs
122 side frame members
123 end frame members
124 arm rest
125 arm resting member
126 arm rest support member
127 arm resting member strut
128 aperture
129 brace member
130 middle seat member
131 panels of wood
140 first backrest portion
141 panels of wood
142 frame member
143 support strut
150 second backrest portion
151 panels of wood
152 frame member
153 support strut
160 convenience table
300 lounge chair
310 right side frame rail
312 left side frame rail
314 end frame
315 arm rest
316 end frame
318 u-shaped legs
330 central seating area
332 straps
340 first backrest portion
341 frame member
342 straps
345 support strut
346 serration
350 second backrest portion
351 frame member
352 straps
355 support strut
360 convenience tray
362 u-shaped member
400 lounge chair
410 right side frame rail
412 left side frame rail
414 end frame
416 end frame
430 middle seat member
440 first backrest portion
441 frame member
442 transverse slats
445 support strut
446 serrations
450 second backrest portion
451 frame member
452 transverse slats
455 intermediate frame member
460 convenience tray

We claim:

1. A reversible lounge chair comprising:

a frame:

a first non-articulated backrest portion pivotally attached to the frame adapted to be utilized by a sunbather to position the sunbather in a first position relative to the sun;

a second non-articulated backrest portion pivotally attached to the frame adapted to position the sunbather in second position relative to the sun, which is 180° rotated from the first position;

a fixed seat section positioned between the first and second backrest positions;

one or more first support struts adapted to releaseably position the first backrest portion in at least one inclined position at or above a horizontal level;

one or more second support struts adapted to releaseably position the second backrest portion in at least one inclined position at or above a horizontal level, each of the one or more second support struts being substantially equal in length to the one or more first struts; and a first horizontal backrest supporting member adapted to support the first backrest portion in a fully reclined position; and a second horizontal backrest supporting member adapted to support the second backrest portion in a fully reclined position, wherein each horizontal backrest supporting member thereby prevents the respective backrest portion from inclining below the horizontal level.

2. The lounge chair of claim 1, further comprising at least one arm rest pivotally connected to the frame movable between a first position in which the armrest is positioned adjacent to the first backrest portion and a second position in which the armrest is positioned adjacent to the second backrest portion.

3. The lounge chair of claim 2, further including a convenience table movably connected to the frame and movable between a first retracted, position and a second, in-use, position in which it can be used as a support.

4. The lounge chair of claim 2, wherein the arm rest includes an arm rest support member connected to the frame, an arm resting member movable between the first and second positions of the arm rest, and a hinge pivotally connecting the arm rest support to the arm resting member.

5. The lounge chair of claim 4, further including a convenience table movably connected to the frame and movable between a first, retracted, position and a second, in-use, position in which it can be used as a support.

6. The lounge chair of claim 4, further comprising a first arm resting member strut adapted to support the arm resting member in the first position, and a second arm resting member strut adapted to support the arm resting member in the second position.

7. The lounge chair of claim 1, further including a convenience table retractably connected to the frame and movable between a first, refracted, position and a second, in-use, position in which it can be used as a support.

8. The lounge chair of claim 1, further comprising a middle seating member fixedly connected to the frame and positioned between the first and second backrest portions.

9. The lounge chair of claim 1, wherein the first and second support struts are sized and shaped to releaseably engage a corresponding location upon the frame to lockingly support each of the first and second backrest portions, respectively, in a plurality of positions between a first, fully-raised, position and a second, fully-reclined horizontal position.

10. A reversible lounge chair comprising:

a frame having at least two horizontal backrest supporting members, the frame supporting:

a stationary first seat section;

a first non-articulated backrest portion pivotally connected to a first end of said seat section;

a second non-articulated backrest portion pivotally connected to a second end of said seat section;

the first and second backrest portions each having one or more support struts pivotally connected to respective bottoms of the respective backrest sections, each support strut being substantially equal in length and configured to adjustably mate with at least one of the two horizontal backrest supporting members; and wherein each of the first and second backrest portions rests on at least one corresponding horizontal backrest supporting member of the at least two horizontal backrest supporting members when the respective backrest portion is in a fully-reclined position, thereby preventing the respective backrest portion from inclining below a horizontal level.

11. The reversible lounge chair of claim 10, further comprising at least one arm rest pivotally connected to the frame movable between a first position in which the armrest is positioned adjacent to the first backrest portion and a second position in which the arm rest is positioned adjacent to the second backrest portion.

12. The reversible lounge chair of claim 11, wherein the arm rest includes an arm rest support member connected to the frame, an arm resting member movable between the first and second positions of the arm rest, and a hinge pivotally connecting the arm rest support to the arm resting member.

13. The reversible lounge chair of claim 12, further comprising a first arm resting member strut adapted to support the arm resting member in the first position, and a second arm resting member strut adapted to support the arm resting member in the second position.

14. The reversible lounge chair of claim 10, further including a convenience table retractably connected to the frame and movable between a first, refracted, position and a second, in-use, position in which it can be used as a support.

15. The reversible lounge chair of claim 10, wherein the first and second support struts are sized and shaped to releaseably engage a corresponding location upon the frame to lockingly support each of the first and second backrest portions, respectively, in a plurality of positions between a first fully-raised, position and a second, fully-reclined position.

* * * * *